US012416224B2

(12) United States Patent
Ding et al.

(10) Patent No.: US 12,416,224 B2
(45) Date of Patent: Sep. 16, 2025

(54) ACTIVE ENERGY-ABSORBING SHOCK ABSORBER FOR PERFORATION COMBINED WELL TESTING

(71) Applicant: Southwest Petroleum University, Chengdu (CN)

(72) Inventors: Liangliang Ding, Chengdu (CN); Kai Wang, Chengdu (CN); Jialin Tian, Chengdu (CN); Hongtao Liu, Chengdu (CN); Yongzhi Xue, Chengdu (CN); Ruifeng Guo, Chengdu (CN); Hongtao Jing, Chengdu (CN); Qiang Zhang, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 18/744,271

(22) Filed: Jun. 14, 2024

(65) Prior Publication Data

US 2024/0328288 A1 Oct. 3, 2024

(30) Foreign Application Priority Data

Mar. 1, 2024 (CN) ..... 202410237601.8

(51) Int. Cl.
*E21B 43/116* (2006.01)
*E21B 43/119* (2006.01)

(52) U.S. Cl.
CPC ..... *E21B 43/1195* (2013.01); *E21B 43/116* (2013.01)

(58) Field of Classification Search
CPC ..... E21B 43/116; E21B 43/1195
See application file for complete search history.

(56) References Cited

FOREIGN PATENT DOCUMENTS

| | | | | |
|---|---|---|---|---|
| CN | 107100598 A | | 8/2017 | |
| CN | 108825181 A | * | 11/2018 | ..... E21B 17/07 |
| CN | 208564517 U | * | 3/2019 | ..... E21B 17/07 |

* cited by examiner

*Primary Examiner* — Jonathan C Weber

(57) ABSTRACT

An active energy-absorbing shock absorber for perforation combined well testing includes a first energy-absorbing mechanism, a second energy-absorbing mechanism and an axial-force cushioning mechanism. The first energy-absorbing mechanism includes a gun body, a gun head, a gun tail joint, a support frame, an energy-absorbing filling layer and a detonation mechanism. The second energy-absorbing mechanism includes an intermediate connecting cylinder, an outer cylinder, a limiting step, a movable impact head, a support base, a hydraulic buffer mechanism, a piston rod, an energy-absorbing spring and an inner cavity piston. The axial-force cushioning mechanism includes a housing, a guide mechanism, a buffer shaft and a multi-stage buffer spring. The absorber with a multi-layer structure is filled with a 7 aluminum material.

9 Claims, 7 Drawing Sheets

ACTIVE ENERGY-ABSORBING SHOCK ABSORBER FOR PERFORATION COMBINED WELL TESTING

CROSS-REFERENCE TO RELATED APPLICATIONS

This application claims the benefit of priority from Chinese Patent Application No. 202410237601.8, filed on Mar. 1, 2024. The content of the aforementioned application, including any intervening amendments thereto, is incorporated herein by reference in its entirety.

TECHNICAL FIELD

This application relates to perforation completion technology, and more particularly to an active energy-absorbing shock absorber for perforation combined well testing.

BACKGROUND

The perforating well-testing combination has gained widespread adoption owing to its quick operation time and its capacity to safeguard oil and gas reservoirs. However, during the perforation operation, the residual energy from the perforating charge generates tremendous impact loads, thereby posing a serious threat to wellbore safety. Therefore, in practical perforation operations, perforating shock absorbers or other measures are frequently applied to the perforating string to alleviate the risk posed by impact loads, thereby enhancing the safety of the perforating string structure.

At present, the perforation shock absorbers are typically positioned at the rear of the perforating string. Nonetheless, there are occurrences of wellbore safety issues, such as failures in the perforating string and packers. The impact loads resulting from the residual energy of the perforating charge can be categorized into two types based on their modes of action: internal impact loads within the perforating gun and annular impact loads within the wellbore.

Existing perforation shock absorbers are predominantly passive devices. For example, as described in Chinese Patent No. 107100598A, these perforation shock absorbers are primarily designed to dampen the vibration resulting from annular impact loads on the perforating string. However, they do not specifically address the targeted mitigation of residual energy from the perforating charge and internal impact loads within the perforating gun, thus failing to fundamentally reduce the energy input of impact loads. As a result, the existing shock absorber devices fail to meet the increasingly stringent demands of perforation operations. Hence, there is a need to develop an active energy-absorbing shock absorber for perforation combined well testing to effectively tackle the above issues present in the prior art.

SUMMARY

For the above issues, the purpose of the present disclosure to provide an active energy-absorbing shock absorber for perforation combined well testing to enhance the wellbore safety. The absorber features a multi-layer structure filled with foam aluminum material in the energy-absorbing filling layer. Leveraging the excellent energy absorption characteristics of foam aluminum in conjunction with the compression energy absorption of springs, buffer fluid and gas, it effectively absorbs radial impact loads, axial impact loads, and annular impact loads within the wellbore, reducing the impact damage to the wellbore and ensuring its safety.

The purpose of this application is achieved through the following technical solutions.

An active energy-absorbing shock absorber for perforation combined well testing, comprising:

a first energy-absorbing mechanism circumferentially arranged;

a second energy-absorbing mechanism for absorbing a detonation load; and an axial-force cushioning mechanism;

wherein the first energy-absorbing mechanism comprises a gun body, a gun head, a gun tail joint, a support frame, an energy-absorbing filling layer and a detonation mechanism; the gun head is provided at a first end of the gun body; the gun tail joint is provided at a second end of the gun body; the support frame is provided inside the gun body; the energy-absorbing filing layer is provided between an outer side of the support frame and an inner side of the gun body; the energy-absorbing filling layer is made of a foamed aluminum material; and the detonation mechanism is provided inside the support frame, and is provided between the gun head and the gun tail joint;

the second energy-absorbing mechanism comprises an intermediate connecting cylinder, an outer cylinder, a limiting step, a movable impact head, a support base, a hydraulic buffer mechanism, a piston rod, an energy-absorbing spring and an inner cavity piston; the intermediate connecting cylinder and the outer cylinder are provided on a side of the gun tail joint away from the gun head;

the movable impact head is provided inside the intermediate connecting cylinder through the limiting step;

the hydraulic buffer mechanism is provided between the intermediate connecting cylinder and the outer cylinder through the support base;

the movable impact head is provided with the piston rod penetrating through the support base;

the energy-absorbing spring is sleevedly provided on a part of the piston rod between the movable impact head and the support base;

an end of the piston rod extends into the hydraulic buffer mechanism, and is provided with the inner cavity piston; and the axial-force cushioning mechanism comprises a housing, a guide mechanism, a buffer shaft and a multi-stage buffer spring; a side of the outer cylinder away from the intermediate connecting cylinder is provided with the housing; the buffer shaft is provided at an end inside the housing through the guide mechanism; and the multi-stage buffer spring is provided on the buffer shaft.

In an embodiment, a part of the gun tail joint inside the gun body is provided with a limiting block;

the support frame is provided between the limiting block and an inner side of the gun head;

the gun body is provided with a blind hole;

the support frame is provided with a through hole;

the detonation mechanism comprises a detonation cord channel, a charge carrier, a plurality of shooting holes, and a detonation cord;

the detonation cord channel is provided penetratingly on the gun head;

the charge carrier is provided between the gun head and the limiting block and provided inside the support frame;

the plurality of shooting holes are arranged on an inner wall of the charge carrier;

the detonation cord is provided inside a part of the detonation cord channel extending into the charge carrier; and the limiting block and the gun tail joint are each provided with a through slot communicating with the intermediate connecting cylinder.

In an embodiment, a sealing ring is provided between the limiting block and the gun tail joint.

In an embodiment, an end face of the gun head facing the limiting block is provided with a first arc-shaped positioning groove and a second arc-shaped positioning groove; an end face of the limiting block facing the gun head is provided with a third arc-shaped positioning groove and a fourth arc-shaped positioning groove; the first arc-shaped positioning groove is in symmetrical arrangement with the third arc-shaped positioning groove, and the second arc-shaped positioning groove is in symmetrical arrangement with the fourth arc-shaped positioning groove;

a first end of the support frame is provided with a first arc-shaped positioning block, and a second end of the support frame is provided with a second arc-shaped positioning block; a first end of the charge carrier is provided with a third arc-shaped positioning block, and a second end of the charge carrier is provided with a fourth arc-shaped positioning block; the first arc-shaped positioning block is in symmetrical arrangement with the second arc-shaped positioning block, and the third arc-shaped positioning block is in symmetrical arrangement with the fourth arc-shaped positioning block; and the first arc-shaped positioning block is configured to fit the first arc-shaped positioning groove for positioning; the second arc-shaped positioning block is configured to fit the third arc-shaped positioning groove for positioning; the third arc-shaped positioning block is configured to fit the second arc-shaped positioning groove for positioning; and the fourth arc-shaped positioning block is configured to fit the fourth arc-shaped positioning groove for positioning.

In an embodiment, a first buffer backing ring is provided between a first end of the energy-absorbing spring and the movable impact head; and a second buffer backing ring is provided between a second end of the energy-absorbing spring and the support base;

the hydraulic buffer mechanism comprises a positioning groove, an inner cavity body, an inner cavity step, a piston ring, a return spring, and a plurality of through-holes;

the inner cavity body is provided inside the outer cylinder through the positioning groove at an end of the outer cylinder away from the intermediate connecting cylinder;

an outer side of the inner cavity body is provided with the piston ring through the inner cavity step;

the return spring is provided between the piston ring and an end face of the support base away from the intermediate connecting cylinder; and the plurality of through-holes are symmetrically arranged on an inner wall of the inner cavity body.

In an embodiment, the inner cavity piston extends into the inner cavity body to be in sealed and movable fit with the inner wall of the inner cavity body;

an inner ring of the piston ring is in sealed and movable fit with an outer wall of the inner cavity body;

an outer ring of the piston ring is in sealed and movable fit with an inner wall of the outer cylinder; and an enclosed space is formed between the inner cavity piston, the piston ring, the inner wall of the outer cylinder, and the outer wall of the inner cavity body, and is filled with a hydraulic fluid.

In an embodiment, the guide mechanism comprises a plurality of guide grooves, a limiting groove, a plurality of guide bars, a square positioning hole, a plurality of fixing pin holes, and a positioning pin;

the plurality of guide grooves are symmetrically arranged on an inner wall of an end of the housing away from the outer cylinder;

each of the plurality of guide grooves is provided with the limiting groove;

the limiting groove is a through groove;

the plurality of guide bars are symmetrically arranged on an outer side of an end of the buffer shaft away from the outer cylinder;

each of the plurality of guide bars is provided with the square positioning hole;

the plurality of fixing pin holes are symmetrically arranged on the buffer shaft and a side wall of the end of the housing away from the outer cylinder; and each of the plurality of fixing pin holes is provided with the positioning pin.

In an embodiment, a slider is provided between the square positioning hole and the limiting groove; and the buffer shaft is configured to cooperate with the plurality of guide grooves and the plurality of guide bars through the slider to achieve guided sliding and limited extension and retraction.

In an embodiment, a diameter of a first end of the buffer shaft is smaller than a diameter of a second end of the buffer shaft;

an inner end of the housing away from the intermediate connecting cylinder is provided with an air cavity;

the first end of the buffer shaft is in sealed and movable fit with the air cavity;

the multi-stage buffer spring comprises a plurality of compression springs and a plurality of buffer washers;

the plurality of compression springs and the plurality of buffer washers are alternately sleeved on an outer side of the first end of the buffer shaft; and the multi-stage buffer spring is configured to be limited to an outer end face of the air cavity.

The advantages of the present disclosure are described as follows.

The absorber features a multi-layer structure filled with foam aluminum material in the energy-absorbing filling layer to absorb the residual energy from perforation charges. By leveraging the excellent energy absorption characteristics of foam aluminum, it effectively reduces the direct energy that causes the impact load to the wellbore annulus, thereby fundamentally lowering the impact load. Additionally, the foam aluminum material possesses good heat and corrosion resistance, making it well-suited for harsh high-temperature and high-pressure environments at the bottom of the well, avoiding the rubber materials from being prone to failure.

Moreover, by leveraging the energy absorption properties of springs and buffer fluid, the absorption of axial impact loads within the perforation charges is achieved. The dual composite energy absorption greatly enhances the applicability upper limit of the energy-absorbing shock absorber in absorbing impact loads.

Finally, by combining the energy absorption properties of springs and gas compression, the absorption of annular impact loads in the wellbore is achieved. This approach mitigates the problem of spring failure under significant impact loads.

In the above figures, 1—gun body, 2—gun head, 3—gun tail joint, 4—support frame, 5—energy-absorbing filling layer, 6—intermediate connecting cylinder, 7—outer cylinder, 8—limiting step, 9—movable impact head, 10—support base, 11—piston rod, 12—energy-absorbing spring, 13—inner cavity piston, 14—housing, 15—buffer shaft, 16—multi-stage buffer spring, 17—limiting block, 18—blind hole, 19—support-frame through-hole, 20—detonation cord channel, 21—charge carrier, 22—shooting holes, 23—detonation cord, 24—through slot, 25—sealing ring, 26—arc-shaped positioning groove, 27—arc-shaped positioning block, 28—buffer backing ring, 29—positioning groove, 30—inner cavity body, 31—inner cavity step, 32—piston ring, 33—return spring, 34—hydraulic-fluid through-hole, 35—guide groove, 36—limiting groove, 37—guide bar, 38—square positioning hole, 39—fixing pin hole, 40—positioning pin, 41—air cavity.

DETAILED DESCRIPTION OF EMBODIMENTS

For a clearer understanding of the present disclosure, it will be described in further detail below with reference to the accompanying drawings and embodiments. The following embodiments are merely used to illustrate the present disclosure and are not intended to limit the scope of the present disclosure.

Figure 1:
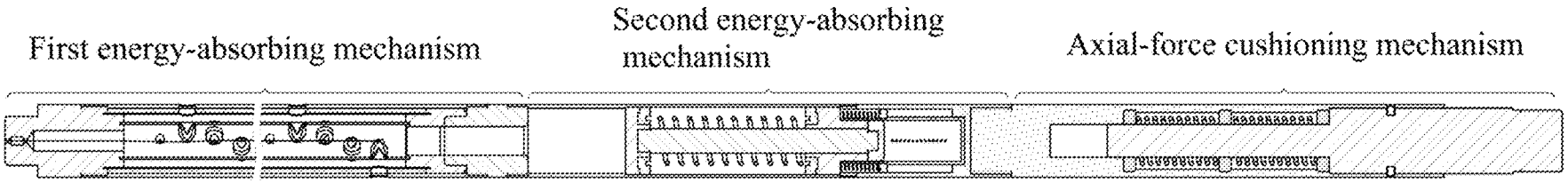
FIG. 1 is a sectional view of the structure of the whole active energy-absorbing shock absorber according to an embodiment of the present disclosure.
Figure 2:
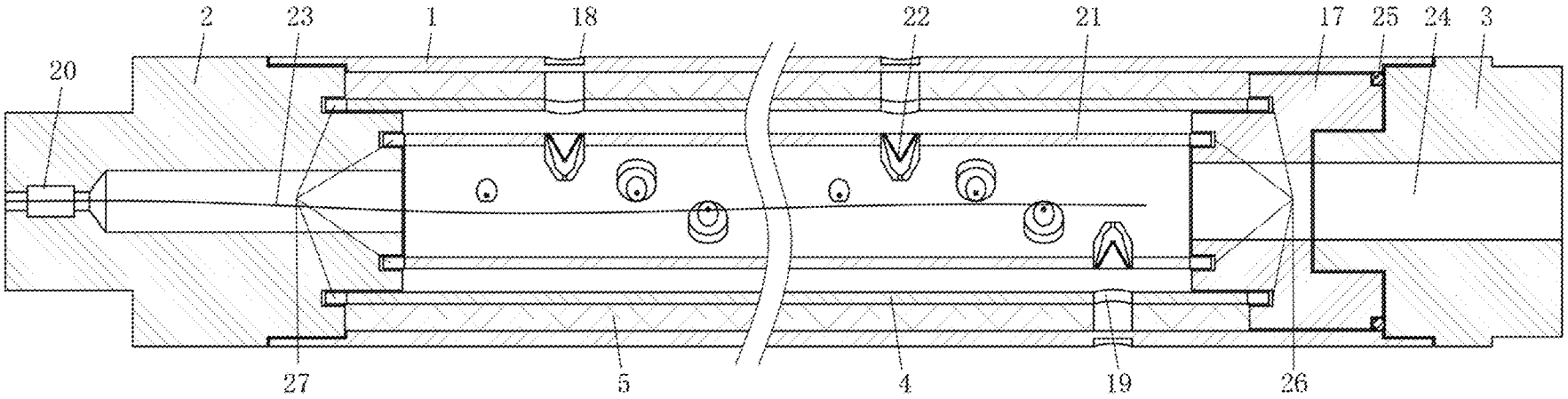
FIG. 2 is a sectional view of the structure of a first energy-absorbing mechanism according to an embodiment of the present disclosure.
Figure 3:
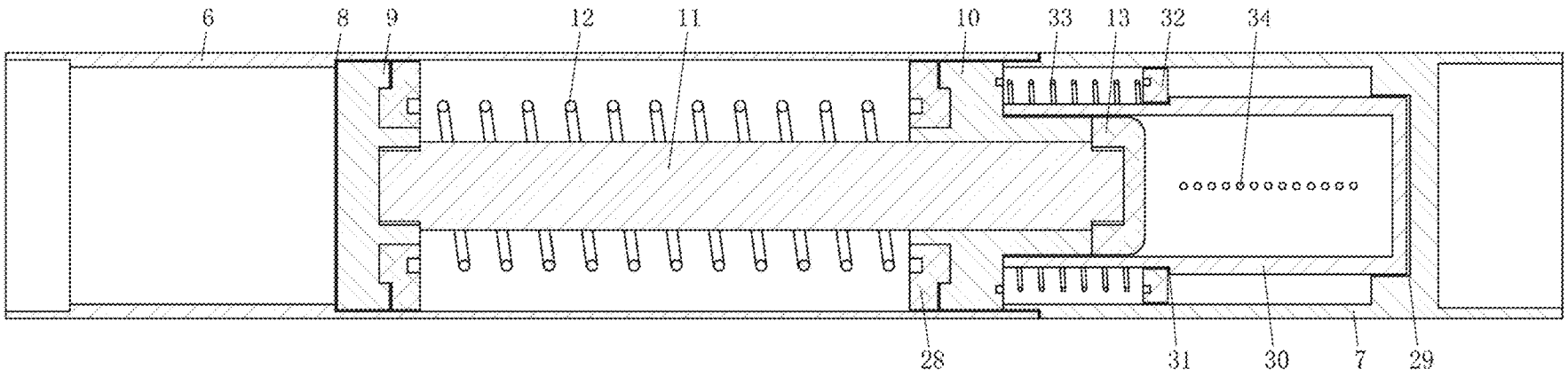
FIG. 3 is a sectional view of the structure of a second energy-absorbing mechanism according to an embodiment of the present disclosure.
Figure 4:
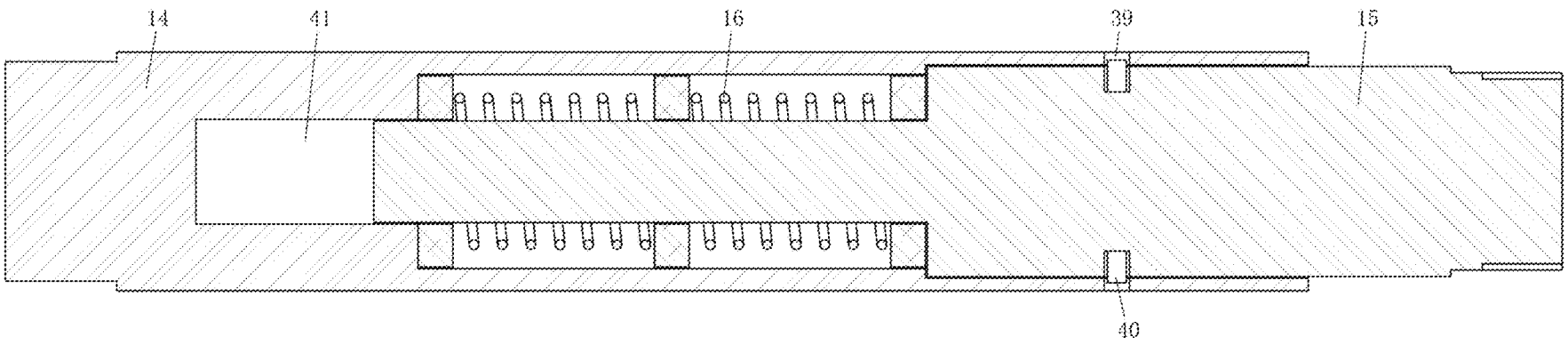
FIG. 4 is a sectional view of the structure of an axial-force cushioning mechanism according to an embodiment of the present disclosure.
Figure 5:
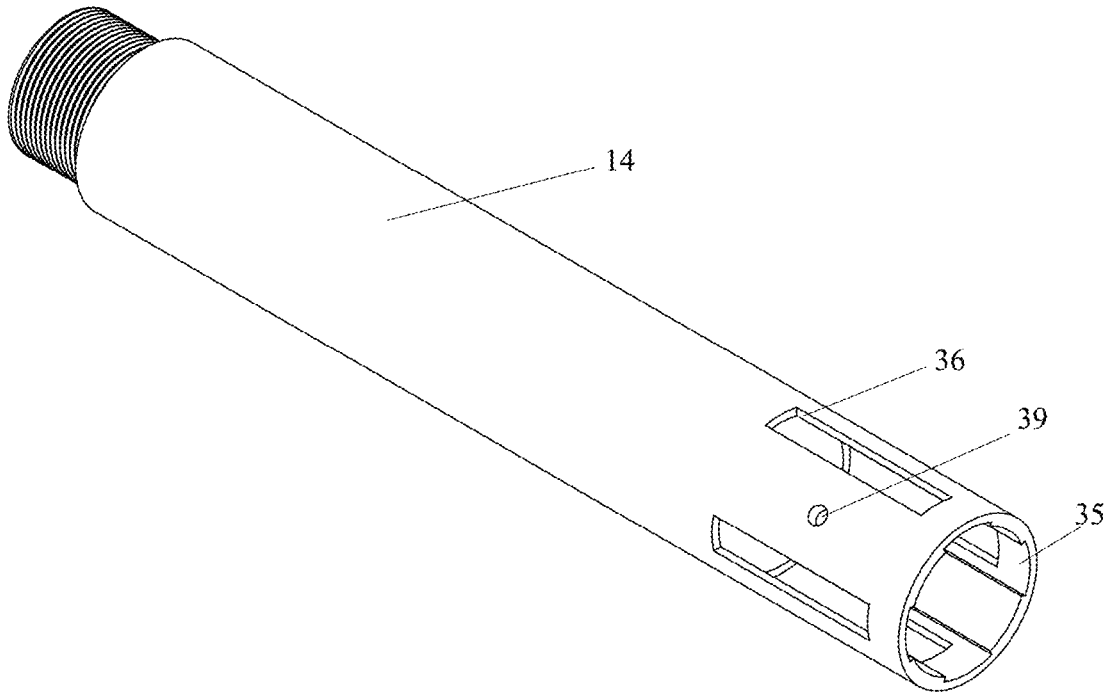
FIG. 5 is a schematic diagram of the structure of a housing according to an embodiment of the present disclosure.
Figure 6:
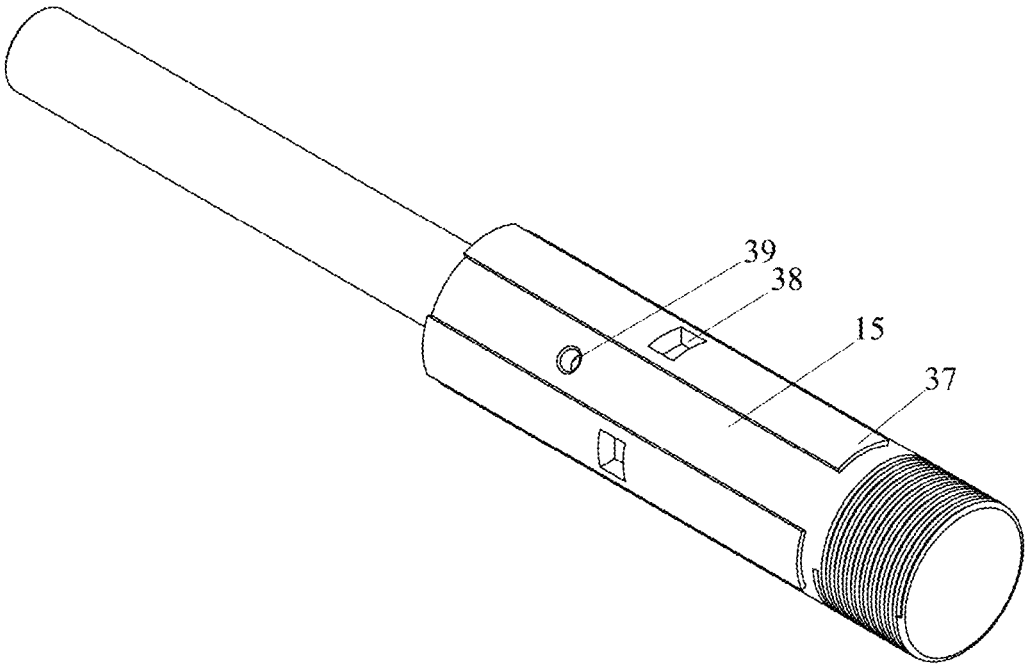
FIG. 6 is a schematic diagram of the structure of a buffer shaft according to an embodiment of the present disclosure.
Figure 7:
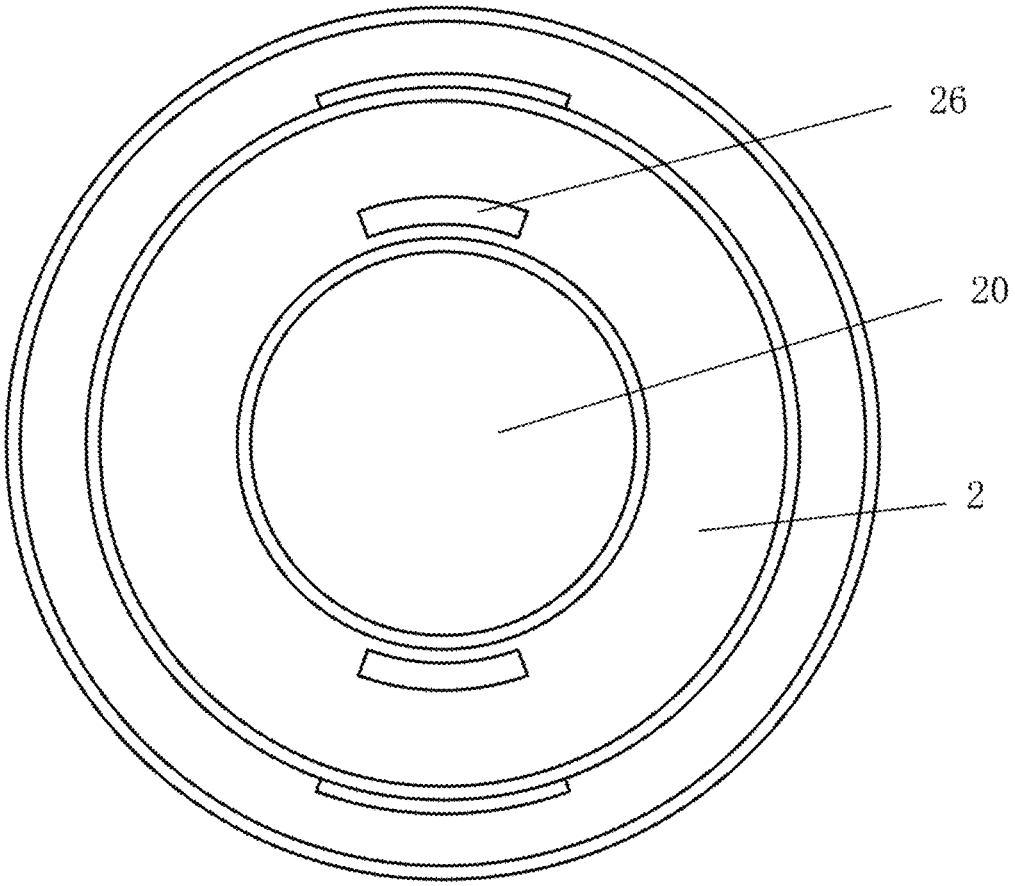
FIG. 7 illustrates the distribution structure of the arc-shaped positioning groove on the end face of the gun head according to an embodiment of the present disclosure.

As shown in FIGS. 1-7, an embodiment of the present disclosure provides an active energy-absorbing shock absorber for perforation combined well testing, which includes a first energy-absorbing mechanism circumferentially arranged, a second energy-absorbing mechanism for absorbing a detonation load, and an axial-force cushioning mechanism. The first energy-absorbing mechanism includes a gun body 1, a gun head 2, a gun tail joint 3, a support frame 4, an energy-absorbing filling layer 5 and a detonation mechanism. The gun head 2 is provided at the first end of the gun body 1, the gun tail joint 3 is provided at the second end of the gun body 1. The two ends of the outer side of the gun head are equipped with external threads, with one end used for installation in the perforating string and the other end fixedly installed by connecting with the internal thread of the gun body. The gun tail joint is also provided with external threads at both ends, with one end fixedly connected to the internal thread of the gun body and the other end installed with the second energy-absorbing mechanism. The support frame 4 is provided inside the gun body 1, the energy-absorbing filling layer 5 is provided between the outer side of the support frame 4 and the inner side of the gun body 1 and is made of a foam aluminum material. The detonation mechanism is provided inside the support frame 4, and is provided between the gun head 2 and the gun tail joint 3. The second energy-absorbing mechanism includes an intermediate connecting cylinder 6, an outer cylinder 7, a limiting step 8, a movable impact head 9, a support base 10, a hydraulic buffer mechanism, a piston rod 11, an energy-absorbing spring 12 and an inner cavity piston 13, the intermediate connecting cylinder 6 and the outer cylinder 7 are mounted on the side of the gun tail joint 3 away from the gun head 2, the movable impact head 9 is provided inside the intermediate connecting cylinder 6 through the limiting step 8, the hydraulic buffer mechanism is provided between the intermediate connecting cylinder 6 and the outer cylinder 7 through the support base 10, the movable impact head 9 is provided with the piston rod 11 penetrating through the support base 10. The end of the piston rod is movably and telescopically adapted to the support base. The energy-absorbing spring 12 is sleevedly provided on the part of the piston rod 11 between the movable impact head 9 and the support base 10, the end of the piston rod 11 extends into the hydraulic buffer mechanism, and is provided with the inner cavity piston 13. The axial-force cushioning mechanism includes a housing 14, a guide mechanism, a buffer shaft 15 and a multi-stage buffer spring 16. The side of the outer cylinder 7 away from the intermediate connecting cylinder 6 is provided with the housing 14 through threads, the end inside the housing 14 is provided with the buffer shaft 15 through the guide mechanism, and the multi-stage buffer spring 16 is sleeved on the buffer shaft 15 inside the housing 14.

The part of gun tail joint 3 inside the gun body 1 is provided with a limiting block 17, the support frame 4 is provided between the limiting block 17 and the inner side of the gun head 2, the gun body 1 is provided with blind holes 18, the support frame 4 is provided with a support-frame through-hole 19. The blind holes 18 are configured to isolate the space inside the gun from the wellbore annulus before perforation. The detonation mechanism includes a detonation cord channel 20, a charge carrier 21, shooting holes 22, and a detonation cord 23. The detonation cord channel 20 is provided penetratingly on the gun head 2, the charge carrier 21 is provided inside the support frame 4 between the gun head 2 and the limiting block 17 and provided inside the support frame 4, the shooting holes 22 are arranged on an inner wall of the charge carrier 21, the detonation cord 23 is provided inside the part of the detonation cord channel 20 extending into the charge carrier 21, the limiting block 17 and the gun tail joint 3 are each provided with a through slot communicating with the intermediate connecting cylinder 6 through the through slot 24.

A sealing ring 25 is provided between the limiting block 17 and the gun tail joint 3 for the sealing of the gun body. The support-frame through-holes 19 are through-holes while the blind holes 18 are non-through holes. The blind holes, support-frame through-holes, and shooting holes are distributed on the outer side of the gun body with a certain phase angle and hole density, and are kept consistent to improve the penetration effect of the perforating charges.

Arc-shaped positioning grooves 26 are symmetrically arranged on an end face of the gun head 2 facing the limiting block 17 and an end face of the limiting block 17 facing the gun head 2, arc-shaped positioning blocks 27 are symmetrically arranged at both ends of the support frame 4 and both ends of the charge carrier 21, and the arc-shaped positioning blocks 27 are matched with the arc-shaped positioning grooves 26 for positioning respectively. Both the arc-shaped positioning blocks and the arc-shaped positioning grooves 26 are arranged in a circular pattern at intervals of 60 degrees. Specifically, the end face of the gun head facing the limiting block is provided with a first arc-shaped positioning groove 26 and a second arc-shaped positioning groove 26; an end face of the limiting block facing the gun head is provided with a third arc-shaped positioning groove 26 and a fourth arc-shaped positioning groove 26; the first arc-shaped positioning groove 26 is in symmetrical arrangement with the third arc-shaped positioning groove 26, and the second arc-shaped positioning groove 26 is in symmetrical arrangement with the fourth arc-shaped positioning groove 26. A first end of the support frame is provided with a first arc-shaped positioning block 27, and a second end of the support frame is provided with a second arc-shaped positioning block 27; a first end of the charge carrier is provided with a third arc-shaped positioning block 27, and a second end of the charge carrier is provided with a fourth arc-shaped positioning block 27; the first arc-shaped positioning block 27 is in symmetrical arrangement with the second arc-shaped positioning block 27, and the third arc-shaped positioning block 27 is in symmetrical arrangement with the fourth arc-shaped positioning block 27. The first arc-shaped positioning block 27 is configured to fit the first arc-shaped positioning groove 26 for positioning; the second arc-shaped positioning block 27 is configured to fit the third arc-shaped positioning groove 26 for positioning; the third arc-shaped positioning block 27 is configured to fit the second arc-shaped positioning groove 26 for positioning; and the fourth arc-shaped positioning block 27 is configured to fit the fourth arc-shaped positioning groove 26 for positioning.

Buffer backing rings 28 are provided between the first end of the energy-absorbing spring 12 and the movable impact head 9, and are provided between the second end of the energy-absorbing spring 12 and the support base 10. The energy-absorbing spring is in a compressed state in its original condition, causing the movable impact head to be compressed and held in place. The hydraulic buffer mechanism includes positioning grooves 29, an inner cavity body 30, an inner cavity step 31, a piston ring 32, a return spring 33 and hydraulic-fluid through-holes 34. The inner cavity body 30 is provided inside the outer cylinder 7 through the positioning grooves 29 at the end of the outer cylinder 7 away from the intermediate connecting cylinder 6. The support base is overlaid at the open end face of the inner cavity body to limit its movement. The outer side of the inner cavity body 30 is provided with the piston ring 32 through the inner cavity step 31, and the return spring 33 is provided between the piston ring 32 and the end face of the support base 10 away from the intermediate connecting cylinder 6. The piston ring and the support base are set with spring grooves on their opposite sides to position the return spring. The hydraulic-fluid through-holes 34 are symmetrically arranged on the inner wall of the inner cavity body 30. The hydraulic-fluid through-holes are arranged in a straight line and symmetrically set in two groups.

The inner cavity piston 13 extends into the inner cavity body 30 to be in sealed and movable fit with the inner wall of the inner cavity body 30, an inner ring of the piston ring 32 is in sealed and movable fit with an outer wall of the inner cavity body 30, an outer ring of the piston ring 32 is in sealed and movable fit with an inner wall of the outer cylinder 7. An enclosed space is formed between the inner cavity piston 13, the piston ring 32, the inner wall of the outer cylinder 7, and the outer wall of the inner cavity body 30, and is filled with hydraulic fluid.

The guide mechanism includes guide grooves 35, limiting grooves 36, guide bars 37, square positioning holes 38, fixing pin holes 39, and positioning pins 40, the guide grooves 35 are symmetrically arranged on an inner wall of an end of the housing 14 away from the outer cylinder 7. The guide grooves 35 are provided with the limiting grooves 36, the limiting grooves 36 are through grooves, and the guide bars 37 are symmetrically arranged on the outer side of the end of the buffer shaft 15 away from the outer cylinder 7. The buffer shaft has a thick section and a thin section, with the guide bars placed on one side of the thick section. The guide grooves and the guide bars are correspondingly set for four groups. Each of the plurality of guide bars 37 is provided with the square positioning hole 38, and the fixing pin holes 39 are symmetrically arranged on the buffer shaft 15 and the side wall of the end of the housing 14 away from the outer cylinder 7. The fixing pin holes are provided on the surface of the thick section. Each of the plurality of fixing pin holes 39 is provided with the positioning pin 40. Due to the above configuration, the buffer shaft is fixedly connected to the housing. The shear of positioning pins is only activated when the buffer shaft is subjected to pressure loads. After the positioning failure, the movable cushioning and shock absorption effect is achieved.

A slider is provided between the square positioning holes 38 and the limiting grooves 36, and the buffer shaft 15 is configured to cooperate with the plurality of guide grooves 35 and the plurality of guide bars 37 through the slider to achieve guided sliding and limited extension and retraction. This configuration prevents the buffer shaft from dislodging.

The diameter of the first end of the buffer shaft 15 is smaller than the diameter of the second end of the buffer shaft 15, the inner end of the housing 14 away from the intermediate connecting cylinder 6 is provided with an air cavity 41, the first end of the buffer shaft 15 (thin section) is in sealed and movable fit with the air cavity 41, the multi-stage buffer spring 16 includes compression springs and buffer washers, the springs and the buffer washers are alternately sleeved on an outer side of the first end of the buffer shaft 15, and the multi-stage buffer spring 16 is configured to be limited to an outer end face of the air cavity 41.

The original states of the energy-absorbing spring, the multi-stage buffer spring and the return springs are compressed.

The active energy-absorbing shock absorber for perforation combined well testing is installed onto the perforating string through the external threads of the gun head to form a stable structure without relative movement when the perforation operation is not performed.

After the perforating charge is detonated, an immense impact load is generated to strike the support frame and compress the energy-absorbing filling layer. Due to the plastic deformation of the foam aluminum, the kinetic energy of the impact load is converted into the internal energy of the energy-absorbing filling layer to absorb the radial impact load of the perforating gun.

Along the axial direction inside the gun body, the impact load will strike the movable impact head in the second energy-absorbing mechanism. When the movable impact head is struck by the impact load, it compresses the energy-absorbing spring and drives the piston rod to generate displacement. The piston rod drives the inner cavity piston to compress the buffer fluid (hydraulic fluid) in the inner cavity body. When the buffer fluid (hydraulic fluid) in the inner cavity body enters the outer cylinder, the buffer fluid (hydraulic fluid) in the outer cylinder compresses the piston ring and squeezes against the return spring. Through the means of energy absorption and buffering provided by the energy-absorbing spring and hydraulic buffer mechanism, the axial impact on the perforation string caused by the internal impact load of the perforating gun can be greatly reduced.

The annular impact load in the wellbore will also cause vibration of the perforation string. Therefore, when the annular impact load is imposed on the bottom of the perforation string, the perforation string will experience an upward impact. At this point, if the impact force on the perforation string exceeds the bearing capacity of the positioning pins, the positioning pins will be sheared off. This leads to relative displacement between the housing and the buffer shaft, compressing the multi-stage buffer spring, which effectively reduces axial forces. Additionally, the compression of the air cavity will also generate a certain cushioning effect.

Due to the above multi-layer energy-absorbing and cushioning structure, the perforating string can be effectively protected.

The above description illustrates the basic principles, main features and advantages of the present disclosure. Those skilled in the art should understand that the embodiments and specification described above are merely used to illustrate the principles of the present disclosure, but are not intended to limit the present disclosure. It should be noted that various changes and improvements made to the present disclosure without departing from the spirit of the disclosure shall fall within the scope of the disclosure defined by the appended claims.

What is claimed is:

1. An active energy-absorbing shock absorber for perforation combined well testing, comprising:

a first energy-absorbing mechanism circumferentially arranged;

a second energy-absorbing mechanism for absorbing a detonation load; and an axial-force cushioning mechanism;

wherein the first energy-absorbing mechanism comprises a gun body, a gun head, a gun tail joint, a support frame, an energy-absorbing filling layer and a detonation mechanism; the gun head is provided at a first end of the gun body; the gun tail joint is provided at a second end of the gun body; the support frame is provided inside the gun body; the energy-absorbing filing layer is provided between an outer side of the support frame and an inner side of the gun body; the energy-absorbing filling layer is made of a foamed aluminum material; and the detonation mechanism is provided inside the support frame, and is provided between the gun head and the gun tail joint;

the second energy-absorbing mechanism comprises an intermediate connecting cylinder, an outer cylinder, a limiting step, a movable impact head, a support base, a hydraulic buffer mechanism, a piston rod, an energy-absorbing spring and an inner cavity piston; the intermediate connecting cylinder and the outer cylinder are provided on a side of the gun tail joint away from the gun head;

the movable impact head is provided inside the intermediate connecting cylinder through the limiting step;

the hydraulic buffer mechanism is provided between the intermediate connecting cylinder and the outer cylinder through the support base;

the movable impact head is provided with the piston rod penetrating through the support base;

the energy-absorbing spring is sleevedly provided on a part of the piston rod between the movable impact head and the support base;

an end of the piston rod extends into the hydraulic buffer mechanism, and is provided with the inner cavity piston; and the axial-force cushioning mechanism comprises a housing, a guide mechanism, a buffer shaft and a multi-stage buffer spring; a side of the outer cylinder away from the intermediate connecting cylinder is provided with the housing; the buffer shaft is provided at an end inside the housing through the guide mechanism; and the multi-stage buffer spring is provided on the buffer shaft.

2. The active energy-absorbing shock absorber of claim 1, wherein a part of the gun tail joint inside the gun body is provided with a limiting block;

the support frame is provided between the limiting block and an inner side of the gun head;

the gun body is provided with a blind hole;

the support frame is provided with a through hole;

the detonation mechanism comprises a detonation cord channel, a charge carrier, a plurality of shooting holes, and a detonation cord;

the detonation cord channel is provided penetratingly on the gun head;

the charge carrier is provided between the gun head and the limiting block and provided inside the support frame;

the plurality of shooting holes are arranged on an inner wall of the charge carrier;

the detonation cord is provided inside a part of the detonation cord channel extending into the charge carrier; and the limiting block and the gun tail joint are each provided with a through slot communicating with the intermediate connecting cylinder.

3. The active energy-absorbing shock absorber of claim 2, wherein a sealing ring is provided between the limiting block and the gun tail joint.

4. The active energy-absorbing shock absorber of claim 2, wherein an end face of the gun head facing the limiting block is provided with a first arc-shaped positioning groove and a second arc-shaped positioning groove; an end face of the limiting block facing the gun head is provided with a third arc-shaped positioning groove and a fourth arc-shaped positioning groove; the first arc-shaped positioning groove is in symmetrical arrangement with the third arc-shaped positioning groove, and the second arc-shaped positioning groove is in symmetrical arrangement with the fourth arc-shaped positioning groove;

a first end of the support frame is provided with a first arc-shaped positioning block, and a second end of the support frame is provided with a second arc-shaped positioning block; a first end of the charge carrier is provided with a third arc-shaped positioning block, and a second end of the charge carrier is provided with a fourth arc-shaped positioning block; the first arc-shaped positioning block is in symmetrical arrangement with the second arc-shaped positioning block, and the third arc-shaped positioning block is in symmetrical arrangement with the fourth arc-shaped positioning block; and the first arc-shaped positioning block is configured to fit the first arc-shaped positioning groove for positioning; the second arc-shaped positioning block is configured to fit the third arc-shaped positioning groove for positioning; the third arc-shaped positioning block is configured to fit the second arc-shaped positioning groove for positioning; and the fourth arc-shaped positioning block is configured to fit the fourth arc-shaped positioning groove for positioning.

5. The active energy-absorbing shock absorber of claim 1, wherein a first buffer backing ring is provided between a first end of the energy-absorbing spring and the movable impact head; and a second buffer backing ring is provided between a second end of the energy-absorbing spring and the support base;

the hydraulic buffer mechanism comprises a positioning groove, an inner cavity body, an inner cavity step, a piston ring, a return spring, and a plurality of through-holes;

the inner cavity body is provided inside the outer cylinder through the positioning groove at an end of the outer cylinder away from the intermediate connecting cylinder;

an outer side of the inner cavity body is provided with the piston ring through the inner cavity step;

the return spring is provided between the piston ring and an end face of the support base away from the intermediate connecting cylinder; and the plurality of through-holes are symmetrically arranged on an inner wall of the inner cavity body.

6. The active energy-absorbing shock absorber of claim 5, wherein the inner cavity piston extends into the inner cavity body to be in sealed and movable fit with the inner wall of the inner cavity body;

an inner ring of the piston ring is in sealed and movable fit with an outer wall of the inner cavity body;

an outer ring of the piston ring is in sealed and movable fit with an inner wall of the outer cylinder; and an enclosed space is formed between the inner cavity piston, the piston ring, the inner wall of the outer cylinder, and the outer wall of the inner cavity body, and is filled with a hydraulic fluid.

7. The active energy-absorbing shock absorber of claim 1, wherein the guide mechanism comprises a plurality of guide grooves, a limiting groove, a plurality of guide bars, a square positioning hole, a plurality of fixing pin holes, and a positioning pin;

the plurality of guide grooves are symmetrically arranged on an inner wall of an end of the housing away from the outer cylinder;

each of the plurality of guide grooves is provided with the limiting groove;

the limiting groove is a through groove;

the plurality of guide bars are symmetrically arranged on an outer side of an end of the buffer shaft away from the outer cylinder;

each of the plurality of guide bars is provided with the square positioning hole;

the plurality of fixing pin holes are symmetrically arranged on the buffer shaft and a side wall of the end of the housing away from the outer cylinder; and each of the plurality of fixing pin holes is provided with the positioning pin.

8. The active energy-absorbing shock absorber of claim 7, wherein a slider is provided between the square positioning hole and the limiting groove; and the buffer shaft is configured to cooperate with the plurality of guide grooves and the plurality of guide bars through the slider to achieve guided sliding and limited extension and retraction.

9. The active energy-absorbing shock absorber of claim 1, wherein a diameter of a first end of the buffer shaft is smaller than a diameter of a second end of the buffer shaft;

an inner end of the housing away from the intermediate connecting cylinder is provided with an air cavity;

the first end of the buffer shaft is in sealed and movable fit with the air cavity;

the multi-stage buffer spring comprises a plurality of compression springs and a plurality of buffer washers;

the plurality of compression springs and the plurality of buffer washers are alternately sleeved on an outer side of the first end of the buffer shaft; and the multi-stage buffer spring is configured to be limited to an outer end face of the air cavity.

* * * * *